US005161130A

United States Patent [19]

Sato et al.

[11] Patent Number: 5,161,130

[45] Date of Patent: Nov. 3, 1992

[54] CLOCK WITH OPENABLE DIAL PIECES

[75] Inventors: Hiroyuki Sato; Nobuhiro Tanaka; Kenji Ohshima, all of Tokyo, Japan

[73] Assignee: Seikosha Co. Ltd., Japan

[21] Appl. No.: 599,133

[22] Filed: Oct. 17, 1990

[30] Foreign Application Priority Data

Oct. 17, 1989 [JP] Japan ..... 1-269918

[51] Int. Cl.[5] ..... G04B 19/00

[52] U.S. Cl. ..... 368/228; 368/223; 368/232; 368/285

[58] Field of Search ..... 368/223, 228, 229, 232-237, 368/285, 76, 80

[56] References Cited

U.S. PATENT DOCUMENTS 4,941,137 7/1990 Kikuchi ..... 368/223

*Primary Examiner*—Bernard Roskoski

*Attorney, Agent, or Firm*—Bruce L. Adams; Van C. Wilks

[57] ABSTRACT

A clock includes two dial pieces laterally openably pivoted to a stationary shaft. The dial pieces in a closed position define a single time display face. When a driving motor is started at any set time, two gears with eccentric cams are rotated in opposite directions; as a result, the dial pieces with cam followers held in contact with the eccentric cams are shifted in laterally opposite directions to take an open position, so that a gimmick normally hidden by the dial pieces in the closed position is exhibited. A spring is attached to the stationary shaft to moderately urge the dial pieces in the direction of opening thereof, or a spring is provided to urge the dial pieces in the direction of opening thereof via two pins provided on the eccentric cams in accord with the center lines thereof, whereby the operation of the dial pieces is attained uniformly irrespective of whether they are opened or closed.

20 Claims, 3 Drawing Sheets

CLOCK WITH OPENABLE DIAL PIECES

BACKGROUND OF THE INVENTION

This invention relates to a clock with laterally openable dial pieces.

Most conventional clocks have stationary dial plates. For example, in gimmicky clocks of the type in which a door opens at a given time to exhibit a decoration, such as doves or dolls, the decoration is exhibited in a space not overlapping with a dial plate and the dial plate is held stationary.

The present applicant has proposed a clock which is characterized in that a mobile decoration such as a doll or the like is disposed behind of dial pieces, and these dial pieces are laterally opened at a given time to exhibit such a decoration. See Japanese Patent Application No. 63-311614. The mechanism of opening and closing the dial pieces in the prior application is characterized in that a lead screw is rotated by a driving motor rotatable in both directions, a female nut is shifted along the lead screw upon rotation thereof, and the shifting of the nut is transferred via a link mechanism to the dial pieces to open and close them.

In such a system as described above, a driving motor rotatable in both directions must be used to open/close the dial pieces. In addition costs increase, two position detecting switches are necessary to detect the open/-close state of the dial pieces, and a large space is required to accommodate a dial piece opening/closing mechanism. Further, more when the dial pieces are to be opened, a heavy load is imposed on the motor, and when they are closed, the weight of the dial pieces acts to promote the rotation of the motor, and thus, a counter electromotive force is generated in a circuit, which has negative influence on the circuit. Additionally, the interval of time necessary for the dial pieces to close is shorter than the interval of time necessary to open, and such imbalance in operation time maker for an appearance which is inferior.

SUMMARY OF THE INVENTION

It is a first object of the present invention to solve the foregoing problems, by providing a clock which can use a dc motor of such small size as used in houses without the need for a complicated mechanism, thereby attaining cost reduction.

It is a second object of the present invention to provide a clock which can make the load on a motor as uniform as possible irrespective of whether dial pieces are being opened or closed, thereby preventing the occurrence of unbalance in operation time.

It is a third object of the present invention to provide a clock which can stop dial pieces at a given position accurately without imposing any excessive force on them when they are closed.

To accomplish the foregoing objects, a clock with openable dial pieces according to the present invention comprises a case in which a timepiece movement is built, a driving motor provided in the case and actuated at any set time, a pair of dial pieces disposed in front of the case and openable laterally about a stationary shaft for defining a single time display face in a closed position, a pair of eccentric cams disposed on two gears provided in the case and rotated in opposite directions by the driving motor, and a pair of cam followers disposed on the dial pieces and shifted in opposite directions in response to the rotation of the eccentric cams.

The clock of the foregoing composition according to the present invention, in one embodiment, may further include a spring whose central portion is supported by the stationary shaft, and by two engaging pins provided on the dial pieces which are engaged with both end portions of the spring, wherein the urging force of the spring acts in the direction of opening of the dial pieces but whose strength is so weak that the dial pieces can close by their own weight.

The clock of the foregoing composition according to the present invention, in another embodiment, may further include a spring whose central portion is supported by a shaft provided on the case, and by two engaging pins provided on the eccentric cams in accord with the center lines thereof which are engaged with both end portions of the spring, wherein the urging force of the spring acts in the direction of opening of the dial pieces via the eccentric cams.

Therefore, when the driving motor is started at a given time, the two gears are rotated in opposite directions, and the two eccentric cams are rotated accordingly. Upon rotation of the eccentric cams, the cam followers provided on the dial pieces are shifted outward, and the dial pieces are opened correspondingly. When the driving motor is started in the same direction after a given interval of time, the cam followers are shifted inward this time, and the dial pieces are closed correspondingly.

The spring has an urging force acting in the direction of opening of the dial pieces; consequently, when the driving motor is started to open the dial pieces, the urging force of the spring adds to the turning force of the motor, that is, the urging force acts so as to decrease the maximum load of the motor. When the motor is started to close the dial pieces, the rotation of the motor is assisted by the weight of the dial pieces, but the urging force of the spring acts oppositely; therefore, a counter electromotive force is prevented from arising in a circuit. The operation of opening and closing of the dial pieces is uniform as a whole.

On the other hand, where the spring is made to act indirectly on the dial pieces via the eccentric cams, when the dial pieces are in the closed state, the urging force of the spring acts only on the eccentric cams, not on the dial pieces; therefore, the dial pieces are stationarily held at a given position.

BRIEF DESCRIPTION OF THE DRAWINGS

The drawings show embodiments of the present invention, in which.

DETAILED DESCRIPTION OF THE INVENTION

Embodiments of the present invention will now be described with reference to the drawings.

Figure 1:
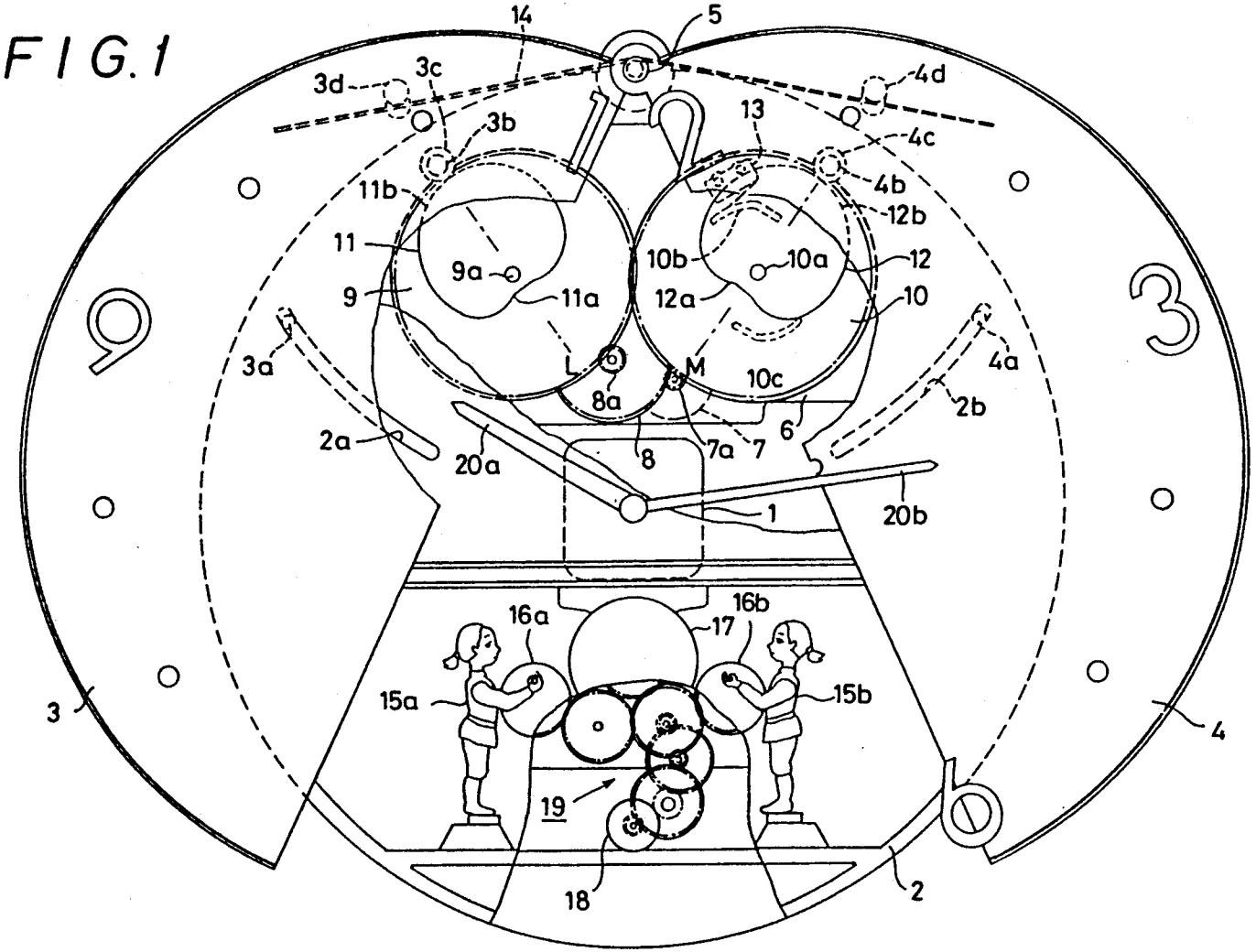
FIG. 1 is a front view, with portions broken away, of one embodiment showing dial pieces in the open state.
Figure 2:
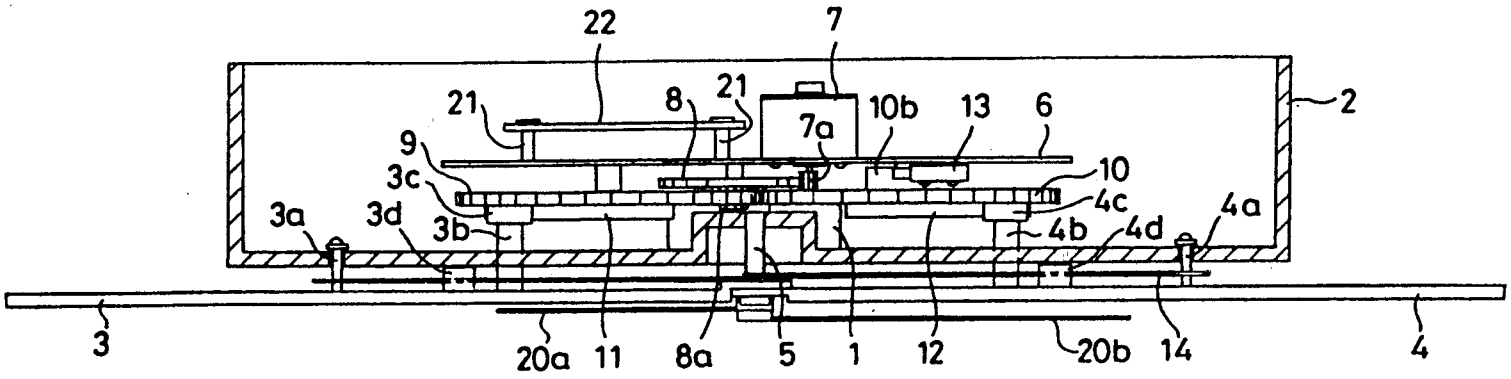
FIG. 2 is a plan view, with a case in cross section.

As shown in FIGS. 1 and 2, a left dial piece 3 and a right dial piece 4 are disposed in front of a case 2 with a timepiece movement 1 built therein. These dial pieces are laterally symmetrical about a straight line defined by connecting the 12 o'clock and 6 o'clock point of a time scale, and are laterally openably pivoted to a stationary shaft 5 provided on the case 2. The two dial pieces or members 3 and 4 in the closed state define a single time display face. To maintain the dial pieces 3 and 4 in a proper position during their opening and closing operation, guide pins 3*a* and 4*a* projecting backward from the dial pieces are guided by guide grooves 2*a* and 2*b* formed in the case 2.

An hour hand 20*a* and a minute hand 20*b*, which are rotated by the timepiece movement 1, are disposed in front of the time display face. The time-indicating hands 20*a*, 20*b* coact with the dial face to indicate time.

A motor supporting plate 6 is provided in the case 2, to which a driving motor 7 is attached, which motor is actuated at any desired set time, for example, at noon. A motor pinion 7*a* engages with a transmission gear 8 whose pinion 8*a* engages with a gear 9. This gear 9 meshes with another gear 10. Therefore, the two gears 9 and 10 are rotated at the same rate in opposite directions by the motor 7.

The gears 9 and 10 have eccentric cams 11 and 12 integrally provided on the front surfaces thereof, which are off set from center shafts 9*a* and 10*a*. The two eccentric cams are in the shape of a heart, and are arranged symmetrically with respect to the center lines L and M of the gears 9 and 10 such that the center shafts 9*a* and 10*a*, small-diameter cam surfaces 11*a* and 12*a*, and large-diameter cam surfaces 11*b* and 12*b* lie on the center lines L and M of the gears.

The gear 10 has actuating plates 10*b* and 10*c* provided on the back surface thereof symmetrically with respect to the center shaft 10*a*, which will turn on and off a micro switch 13 for stopping the driving motor 7.

The back surfaces of the dial pieces or members 3 and 4 have shafts 3*b* and 4*b* projecting therefrom, whose ends rotatably support cam followers 3*c* and 4*c* held in contact with the cam surfaces of the eccentric cams 11 and 12. Further, the back surfaces of the dial pieces 3 and 4 have engaging pins 3*d* and 4*d* projecting therefrom, which are engaged with both end portions of a spring 14 whose central portion is supported by the stationary shaft 5.

As shown in FIG. 1 at the bottom, an exemplary mobile decoration is provided, which comprises dolls 15*a* and 15*b* and rotating members 16*a*, 16*b* and 17, and is visible from the front of the clock; when the dial pieces 3 and 4 are opened laterally. A motor 18 for driving the mobile decoration is provided at the back of the case 2 such that the rotation of this motor is transferred via a gear train 19 to the rotating members 16*a*, 16*b* and 17. A bright pattern or figure is painted on the front surface of the rotating member 17.

In FIG. 2, a circuit board 22, in which a drive circuit of the driving motor 7 is formed, is secured to the back (upper side) of the motor supporting plate 6 by means of pillars 21.

In the foregoing structure, during the ordinary operation of time counting, the cam followers 3*c* and 4*c* are in contact with the small-diameter cam surfaces 11*a* and 12*a*, the dial pieces 3 and 4 are in the closed state, defining the single time display face, and time is indicated by the hands 20*a* and 20*b*. When the driving motor 7 is started at any preselected set time, the rotation of the driving motor is transferred to the gears 9 and 10 so that they are rotated in opposite directions in synchronism, and the eccentric cams 11 and 12 are also rotated in opposite directions, for example, the eccentric cam 11 is rotated clockwise and the eccentric cam 12 is rotated counterclockwise. In response to the rotation of the eccentric cams 11 and 12, the contact point of each of the cam followers 3*c* and 4*c* with the cam surface shifts from the small-diameter cam surface 11*a* or 12*a* to the large-diameter cam surface 11*b* or 12*b*, that is, the cam followers shift oppositely outward; consequently, the dial pieces 3 and 4 are gradually opened. Since the spring 14 has an urging force acting in the direction of opening, this urging force lightens the load of the motor 7; therefore, the dial pieces 3 and 4 are smoothly opened. In the position shown in FIG. 1 where the cam followers 3*c* and 4*c* are in contact with the large-diameter cam surfaces 11*b* and 12*b*, the micro switch 13 is actuated by the actuating plate 10*b*; as a result, the driving motor 7 is stopped.

While the dial pieces 3 and 4 are stationarily held in the open state, the motor 18 for the mobile decoration is started; consequently, the rotating members 16*a*, 16*b* and 17 are rotated by means of the transmission gear train 19. The dolls 15*a* and 15*b* are rocked in the fore-aft direction in response to the rotation of the rotating members 16*a* and 16*b*, thus appearing as if the dolls are turning the rotating members. During this period, a melody is performed or a given number of time signals are generated.

Then, when the driving motor 7 is started to close the dial pieces 3 and 4, similarly to the foregoing operation, the rotation of the driving motor is transferred to the gears 9 and 10, the gears 9 and 10 together with the eccentric cams 11 and 12 are rotated in the same manner as above, that is, the eccentric cam 11 is rotated clockwise, and the eccentric cam 12 is rotated counterclockwise. In response to the rotation of the eccentric cams 11 and 12, the contact point of each of the cam followers 3*c* and 4*c* with the cam surface shifts from the large-diameter cam surface 11*b* or 12*b* to the small-diameter cam surface 11*a* or 12*a*, that is, the cam followers shift oppositely inward; consequently, the dial pieces 3 and 4 are gradually closed. At this time, although the rotation of the motor 7 is urged by the weight of the dial pieces, since the spring 14 has an urging force acting in the direction of opening of the dial pieces, the urging force of the spring acts in the direction opposite to the direction of motion of the dial pieces 3 and 4; therefore, the operation of the dial pieces becomes uniform as a whole irrespective of whether they are opened or closed. In this way, the dial pieces 3 and 4 are progressively closed smoothly, and at the position where the cam followers 3*c* and 4*c* come into contact with the small-diameter cam surfaces 11*a* and 12*a*, the micro switch 13 is actuated by the actuating plate 10*c*; as a result, the driving motor 7 is stopped.

In this embodiment, since the urging force of the spring 14 still acts on the dial pieces even after the dial pieces 3 and 4 are closed, the urging force of the spring 14 is to be accurately set weaker than the force the closing of the dial pieces 3 and 4 caused by their own weight.

Figure 3:
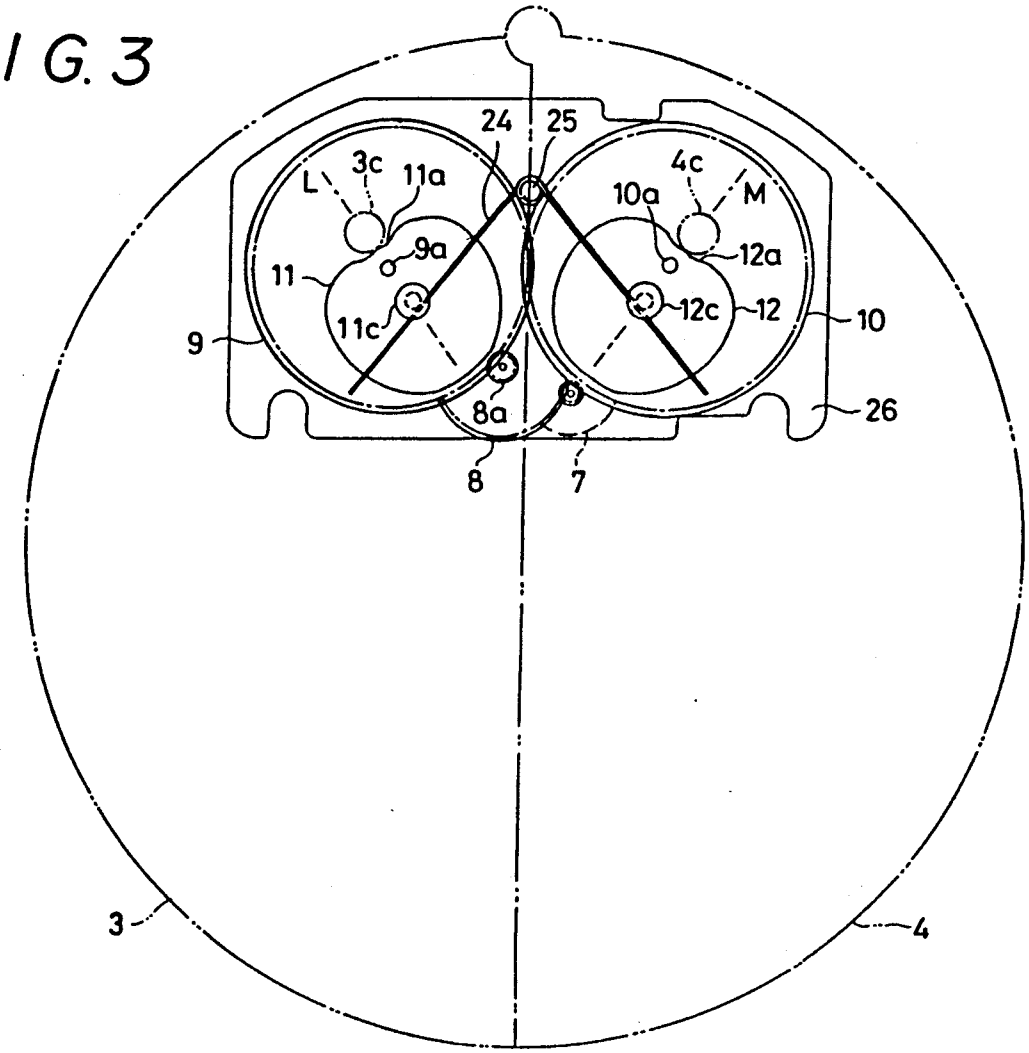
FIG. 3 is a fragmentary front view, showing another embodiment.

FIG. 3 shows another embodiment which is free from such limitations as described above. Specifically, a shaft 25 is provided on a supporting plate 26 secured to the case 2, and a spring 24 is supported at its central portion by this shaft 25. Engaging pins 11*c* and 12*c* are provided on the eccentric cams 11 and 12 in accord with the center lines L and M thereof, which are engaged with both end portions of the spring 24. The urging force of the spring 24 acts in the direction of opening of the dial pieces 3 and 4 via the eccentric cams 11 and 12.

In the foregoing structure, the spring 24 acts indirectly on the dial pieces 3 and 4 via the eccentric cams 11 and 12. Therefore, when the dial pieces 3 and 4 are in the closed state and the cam followers 3*c* and 4*c* are in contact with the small-diameter cam surfaces 11*a* and 12*a* as shown in FIG. 3, the urging force of the spring 24 acts in a direction close to the radial direction or the direction of each of the center lines L and M, and is borne by the center shafts 9*a* and 10*a* of the gears 9 and 10 via the engaging pins 11*c* and 12*c*, not reaching the dial pieces 3 and 4. Accordingly, the dial pieces 3 and 4 are perfectly closed and stationarily held at a given position by virtue of their own weight. Therefore, it is not necessary to set the urging force of the spring 24 weaker than the force of closing of the dial pieces 3 and 4 caused by the weight thereof.

When the driving motor 7 is started to open/close the dial pieces 3 and 4, the gears 9 and 10 are rotated, the engaging pins 11*c* and 12*c* are shifted from their stationary positions, the urging force of the spring 24 acting on the engaging pins gradually deviates from the radial direction or the direction of each of the center lines L and M, or gradually comes into alignment with the direction in which a turning force is applied to the center shaft 9*a* and to the center shaft 10*a*, and similarly to the first embodiment, the direction of the urging force of the spring 24 becomes identical with or opposite to the direction of motion of the dial pieces 3 and 4 caused by the driving motor 7, whereby the operation of opening/closing of the dial pieces can be attained uniformly.

According to the present invention, the dial pieces are opened and closed by means of the eccentric cams driven by the driving motor; therefore, the structure of the clock can be simplified, the size can be decreased, and the cost can be reduced. Since the spring is engaged with the dial pieces, the load of the motor becomes uniform irrespective of whether the dial pieces are opened or closed, the maximum load of the motor can be decreased, and the operation of opening and closing the dial pieces becomes free of any imbalance in operation time. Where the spring is used such that its urging force acts via the eccentric cams, the urging force of the spring does not act on the dial pieces kept in the closed state; thus, the dial pieces can be held at the correct stationary position by virtue of their own weight.

We claim:

1. A clock with openable dial pieces comprising: a case containing therein a timepiece movement, a driving motor provided in the case and actuated at any preselected time, a pair of dial pieces disposed in front of the case and openable laterally about a stationary shaft and defining a single time display face in a closed position, a pair of gears provided in the case and rotated in opposite directions by the driving motor, a pair of eccentric cams disposed on the gears, respectively, for movement therewith, and a pair of cam followers disposed on the dial pieces and engageable with the respective cams so that the cam followers are shifted in opposite directions in response to the rotation of the eccentric cams.

2. A clock with openable dial pieces according to claim 1, further including a spring having a central portion supported by the stationary shaft and two end portions, and two engaging pins provided on the dial pieces and engaged with the two end portions of the spring, wherein the urging force of the spring acts in the direction of opening of the dial pieces, the urging force being sufficiently weak to permit the dial pieces to close by their own weight.

3. A clock with openable dial pieces according to claim 1, further including a spring having a central portion supported by a shaft provided on the case and two end portions, and two engaging pins provided on the eccentric cams and engaged with the two end portions of the spring, wherein the urging force of the spring acts in the direction of opening of the dial pieces via the eccentric cams.

4. A timepiece comprising: a case having a front side; a dial disposed on the case front side, the dial having a pair of dial members movably mounted on the case for movement between a normally closed state in which the dial members substantially cover the case front side and an open state in which the dial members at least partly uncover the case front side; rotatable time-indicating means coacting with the dial for indicating time; timekeeping means for keeping time and rotationally driving the time-indicating means as a function of time; driving means for driving the dial members in opening and closing directions between the closed and open states, the driving means including a pair of angularly displaceable gears, a cam connected to each gear for angular displacement therewith, means including a cam follower engageable with each cam for effecting opening and closing movement of the dial members in response to angular displacement of the cams, and means for angularly displacing the gears to effect angular displacement of the cams; and a decoration mounted on the case behind the dial and positioned on the case so as to be concealed from view by the dial members when the same are in the closed state and to be exposed for viewing from the case front side when the dial members are in the open state.

5. A timepiece according to claim 4; wherein the means for angularly displacing the gears comprises a drive motor operative when energized for producing a rotary output, and a gear train for transmitting the rotary output of the motor to the gears.

6. A timepiece according to claim 5; including an actuating member carried by one of the gears, and an actuatable switch positioned in the path of travel of the actuating member so as to be actuated by the actuating member when the one gear is angularly displaced to a predetermined position to effect deenergization of the drive motor.

7. A timepiece according to claim 4; wherein the means for angularly displacing the gears comprises means for angularly displacing the gears in synchronism in opposite directions.

8. A timepiece according to claim 7; including means mounting the dial members for pivotal movement about a common point; and wherein the means for effecting opening and closing movement of the dial members includes means for effecting pivotal opening and closing movement of the dial members in synchronism with one another.

9. A timepiece according to claim 8; wherein the decoration comprises a mobile decoration mounted to undergo movement, and means for moving the decoration.

10. A timepiece according to claim 9; wherein the mobile decoration has a plurality of decorative movable parts.

11. A timepiece according to claim 4; wherein the decoration comprises a mobile decoration mounted to undergo movement, and means for moving the decoration.

12. A timepiece according to claim 11; wherein the mobile decoration has a plurality of decorative movable parts.

13. A timepiece according to claim 4; including spring means for urging the dial members in the opening direction to assist the driving means in moving the dial members in the opening direction.

14. A timepiece according to claim 13; wherein the urging force of the spring means is weak enough to permit the dial members to overcome the urging force and move in the closing direction due to their own weight.

15. A timepiece according to claim 13; wherein the spring means has a central portion supported on the case and two opposite end portions engageable with the respective dial members.

16. A timepiece according to claim 13; wherein the spring means has a central portion supported on the case and two opposite end portions engageable with the respective cams whereby the urging force of the spring means acts through the cams and gears to urge the dial members in the opening direction.

17. A timepiece according to claim 16; wherein the cams are eccentrically mounted on the gears, and the end portions of the spring means engage with the cams at points lying along a center line of the cams passing through the eccentric mounting points of the cams.

18. A timepiece according to claim 13; wherein the decoration comprises a mobile decoration mounted to undergo movement, and means for moving the decoration.

19. A timepiece according to claim 18; wherein the mobile decoration has a plurality of decorative movable parts.

20. A timepiece according to claim 13; wherein the means for angularly displacing the gears comprises means for angularly displacing the gears in synchronism in opposite directions.

* * * * *